US006067054A

United States Patent [19]

Johannisson et al.

[11] Patent Number: 6,067,054

[45] Date of Patent: May 23, 2000

[54] METHOD AND ARRANGEMENT RELATING TO ANTENNAS

[75] Inventors: Björn Johannisson, Kungsbacka; Ingmar Karlsson, Kållered, both of Sweden

[73] Assignee: Telefonaktiebolaget LM Ericsson, Stockholm, Sweden

[21] Appl. No.: 09/061,962

[22] Filed: Apr. 17, 1998

[30] Foreign Application Priority Data

Apr. 18, 1997 [SE] Sweden ..... 9701475

[51] Int. Cl.[7] ..... H01Q 21/00; H01Q 21/12

[52] U.S. Cl. ..... 343/816; 343/814; 343/815

[58] Field of Search ..... 343/814, 815, 343/816, 882, 861, 880, 818, 811, 700 MS; H01Q 21/12, 21/00

[56] References Cited

U.S. PATENT DOCUMENTS

| | | | |
|---|---|---|---|
| 4,249,181 | 2/1981 | Lee | 455/50 |
| 5,440,318 | 8/1995 | Butland et al. | 343/814 |
| 5,907,305 | 5/1999 | Epp et al. | 343/701 |

FOREIGN PATENT DOCUMENTS

38746/93 7/1993 Australia .

*Primary Examiner*—Hoanganh Le
*Attorney, Agent, or Firm*—Burns, Doane, Swecker & Mathis, L.L.P.

[57] ABSTRACT

A method and arrangement improve antenna performance parameters. The antenna includes a radiating device for radiating a beam in a substantially predefined direction. The radiating device is provided on a supporting structure. The arrangement includes at least one device to mechanically tilt the radiating device in a first direction substantially diverging from the predefined direction, and a device to tilt the beam in a second substantially opposite direction electrically.

28 Claims, 7 Drawing Sheets

METHOD AND ARRANGEMENT RELATING TO ANTENNAS

TECHNICAL FIELD

The present invention relates to a method and arrangement, which by means of tilting improves some performance parameters of an antenna, for example an antenna used in a cellular mobile communications system.

Moreover, the invention relates to an antenna employing microstrip antenna elements and dual polarization.

BACKGROUND

The rapid development of the mobile communications demands antennas having specific characteristics. Several kinds of antennas, such as antennas provided with dipole radiation elements or flat antennas employing so-called microstrip patch elements are known and widely used in applications related to mobile communications. The cell structure of the cellular mobile communications system is assumed to be known for a person skilled in the art and will not be described further here.

Generally, in an antenna comprising dipole antenna elements, several pairs of centrally fed dipole antenna elements are arranged on a panel forming the electrical ground plane. The antenna elements are fed with the signals to be radiated through a feed network. The antenna elements may be formed of a conductive material, for example brass or the like. The radio frequency signal is supplied through a port to the feed network which feeds the dipole elements. Alternating the line lengths of the feed network to each dipole element to generate phase delays is possible.

In an antenna employing the microstrip technique, the antenna generally comprises a number of antenna elements or patches over a ground plane and a distribution network. The distribution network can be realized using microstrip conductors in the same level as the radiating patches or on the other side of the ground plane. In the first case the conductors are simply connected to the sides of the patches. In the second case they are connected either galvanically with a separate conductor through a hole in the ground plane, so-called probe feeding or electromagnetically with coupling through an elongated resonant aperture in the ground plane, so-called aperture coupling. in some antenna designs the distribution network has two separate branches connecting two different polarizations to the antenna elements.

There are several important performance parameters, in particular for coverage of a sector in a cellular mobile communications system by means of base station antennas, for example a voltage standing wave ratio (VSWR), front-to-back radiation ratio and isolation between the polarization ports (in antennas using different polarizations). It is important that the radiation in rear direction of the antenna is maintained low towards the horizon, i.e. at elevation angle 0°, to reduce the level of interference in neighbouring cells and obtain high isolation. Generally, a high VSWR results in signal losses due to mismatch and a low isolation between the polarization ports, for example in a dual polarised antenna reduces the polarization diversity the gain and it will increase the filter requirements in the transmitted signal path of the base station.

In many installations the antennas are arranged to optimise the coverage, e.g. through high gain directed towards the cell edge, preferably very close to the horizon. In this case the back radiation, hereinafter called the rear beam, also has its maximum directed horizontally, which results in a relatively low front-to-back radiation ratio. In the radiating part of the antenna consisting of radiating element and feed network, it is easier to obtain low VSWR and higher isolation through the design and using electrical tilt, as the VSWR and coupling effects usually originate from the radiating elements.

Tilting the beam of an antenna, both electrically or mechanically to obtain certain features is known. For example U.S. Pat. No. 5,440,318 and Australian Patent No. 656857 (by the same inventors), describe arrangement of a panel antenna, particularly suitable for use in cellular communications system. The panel antenna, including bipolar radiating elements, comprises means to tilt the beam of the antenna downwards, both mechanically and electrically. The electrical tilting is mainly used for aesthetic reasons and secondly as a coarse method while the mechanical tilting is used as a fine method. These documents only discuss the down tilting of the beam.

U.S. Pat. No. 4,249,18 1 describes an arrangement to improve the average signal-to-interference ratio in at least one communication cell region by tilting the antenna gain pattern center-beam line of an antenna below the horizon. The antenna is tilted downwards by a predetermined amount. Antenna tilting is achieved either electrically or mechanically.

None of the above documents mention or show a method or arrangement for solving problems solved by the present invention. Even though, above Australian patent mentions an increased front-to-back ratio, this is achieved arranging the sidewalls of the panel negatively. Moreover, the up-tilting of the antenna beam is neither discussed nor shown in the prior art. The prior art solves specific problems which also may be solved through present invention, but they do not provide for any solutions for the problems solved by the present invention.

SUMMARY

The main object of the present invention is to present an arrangement and a method at antennas, which improves and provides for good (i.e. large) coverage, high front-to-back radiation ratio, low VSWR and high isolation. All these problems are advantageously solved substantially simultaneously.

Another object of the present invention is to provide above solutions by means of a simple and cost-effective arrangement and method, which can be used and applied to different kinds of antenna types. Moreover, the feed network of the antenna according to the present invention, can be constructed simpler to obtain low VSWR and coupling. In antennas using electrical tilting, the signals are distributed to the radiation elements through different phase delays, whereby the reflected signals, as well as the possible leakage signals due to the limited isolation are essentially combined in the same feed networks and thereby the signals are not added coherently, resulting in reduction of the maximum amplitude.

In an exemplary embodiment the antenna arrangement includes at least one device to mechanically tilt the radiating means in a first direction substantially diverging from a predefined direction, and means to tilt the said beam in a second substantially opposite direction electrically. According to an exemplary embodiment, said means to electrically tilt the beam in the second direction, directs the beam with a same amount as the mechanical tilting in the first direction.

In an embodiment, the device for mechanical tilting, directs the radiating elements substantially downwards or upwards and means to, electrically, tilt the beam directs the beam substantially upwards or downwards, respectively. The device can consist of a bar, hinge, motor or the like. The mechanical tilting may be adjustable and remote-controlled or the mechanical tilting may be fixed. In one embodiment, also, the electrical tilting is adjustable and remote-controlled or it is fixed.

In yet another embodiment, the radiating elements consist of dipole elements arranged in groups and energized through a distribution network. The distribution network includes distribution lines having adjustable length and the electrical tilting of the beam is mainly performed by adjusting the lengths of the distribution lines of the distribution network, which results in different feeding phase length to the dipole elements producing a substantially progressive phase front over the antenna elements and in an electrical tilt of the beam.

In another embodiment the radiating elements consist of microstrip patch elements energized through a distribution network and the distribution network includes interconnecting lines. To tilt the beam electrically, the interconnecting lines of the distribution network between the antenna elements are designed to produce a progressive phase front, resulting in an electrical tilt of the beam.

A method for improving antenna performance parameters, according to the present invention, where the said antenna mainly comprises radiating means, for radiating a beam in a substantially predefined direction, said radiating means preferably being provided on a supporting structure is characterised in tilting the radiating means in a first direction mechanically to redirect the beam away from said substantially predefined direction and tilting the beam in a second opposite direction electrically. According to an exemplary embodiment the electrically tilting in the second direction has same amount as the mechanical tilting in the first direction.

In an exemplary embodiment the antenna arrangement substantially comprises: a first layer including conductive layers arranged on an insulating substrate, a second layer of a conductive material connected to ground and having at least one first and second apertures oriented substantially perpendicular, i.e. horizontally and vertically, first and second distribution networks including first and second group of conductors connected to first and second feed ports. The antenna further comprises a device to tilt the antenna elements in a first direction mechanically and means to tilt said beam in a second direction electrically.

BRIEF DESCRIPTION OF THE DRAWINGS

In the following, the invention will be further described under reference to non-limiting embodiments illustrated in the enclosed drawings, in which.

DETAILED DESCRIPTION

For better understanding the fundamental principles of the invention, an example showing a very schematic antenna arrangement of a mobile communications system, preferably a cellular communications system for a three-sector site will be disclosed in the following. The disclosure is of course not limited to such a system, and the arrangement according to the invention may be used in any application, in which above-mentioned problems are intended to be solved.

Figure 1:
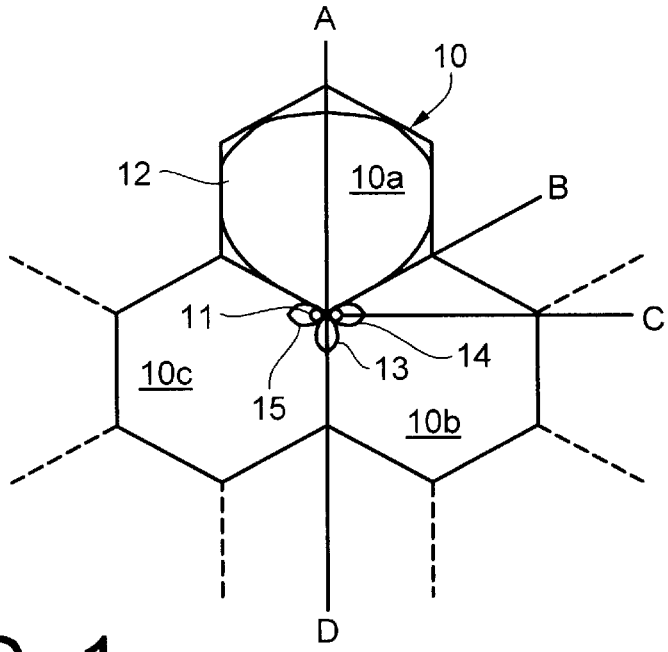
FIG. 1 is a schematic top view of a sector coverage of a base station antenna.

FIG. 1 shows a top view of a cell structure of a cellular system comprising cells 10. In a three-sector site a base station antenna arrangement 11 is provided in the conjunction of three cells 10*a*, 10*b* and 10*c* including three antennas, one for each cell. In FIG. 1 only the antenna 11 and its coverage of its main beam represented by 12 for cell 10*a* are illustrated. In this case, the coverage is typically ±60° for each antenna. Lines designated A–D indicate four directions from the antenna, where:

A is azimuth=0°,

B is azimuth=60°,

C is azimuth=90°, and

D is azimuth=180°.

"A" also indicates the propagation direction of the main beam. A secondary radiation direction having an axis, which makes an angle of approximately 180° with the forward direction of the axis of the frontal radiation 12 of the antenna is indicated by 13, 14 and 15 denote two side radiation directions, respectively.

Figure 2:
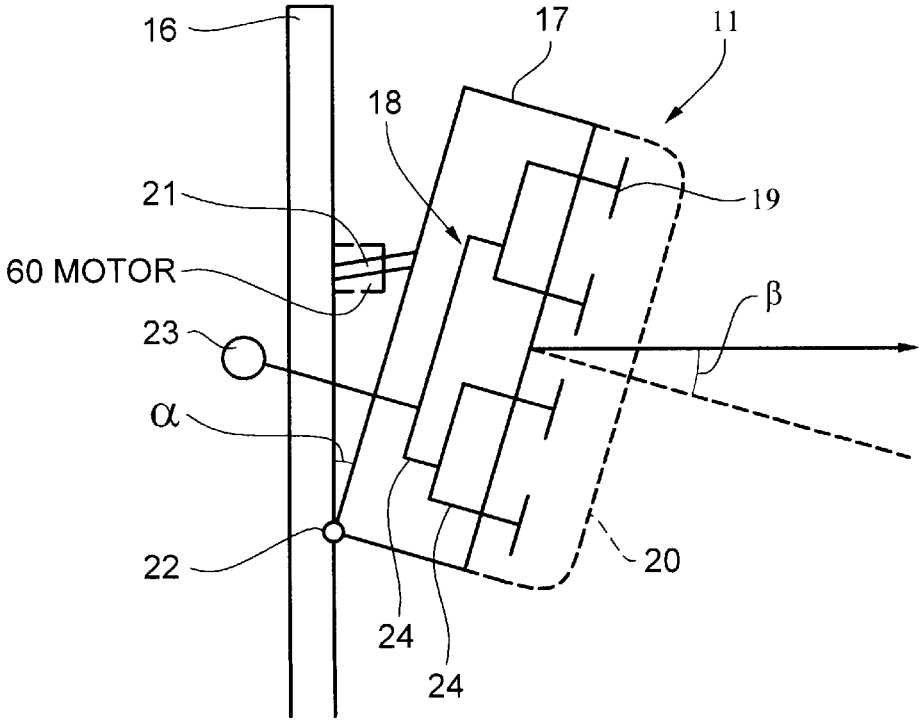
FIG. 2 is a very schematic side view of an antenna embodiment with mechanical down-tilt and electrical up-tilt according to the present invention.

FIG. 2 shows a mechanically down-tilted antenna 11, arranged on a supporting structure 16, such as a post, mast, a wall of building or the like. The arrow shows the substantially predefined main beam direction of the antenna. The main beam is up-tilted electrically substantially back to the predefined radiation direction, which will be described later. The dashed line indicates the direction along which the antenna beam should have radiated if no electrical up-tilt was involved. The antenna comprises a casing 17, housing a substantially parallel distribution network 18 and antenna dipole elements 19. A cover 20 may be arranged in front of the dipole elements 19. The distribution network is fed by a signal through the feed port 23. The antenna 11 is attached to the mast 16 and down-tilted, for example by means of a bar 21. An additional hinge 22 may be arranged as an extra support. The antenna is down tilted at an angle $\alpha$, i.e. the angle between the back side of the antenna housing 17 and the mast 16, which in this case represent the tilt angle of the plane of the antenna elements 19. Furthermore, the main beam of the antenna is electrically up-tilted at an angle $\beta$, i.e. the angle between the arrow and the dashed line. $\beta$ is equal or substantially equal to $\alpha$, thereby directing the main beam substantially at zero angle of elevation.

The electrical tilting of the beam is mainly performed by adjusting the lengths of the distribution lines 24 of the distribution network 18, which results in a shorter feeding phase length to the dipole elements 19 arranged in the lower part of the antenna, i.e. closest to the ground. As it appears from the drawing, the dipole elements are grouped in two, first lower and second upper groups. Moreover, the length of the distribution lines between dipole elements of each group is adjusted so that a phase delay between dipole elements is obtained. Using this method a progressive phase front over the antenna elements is obtained, resulting in an electrical up-tilt of the beam.

Figure 3A:
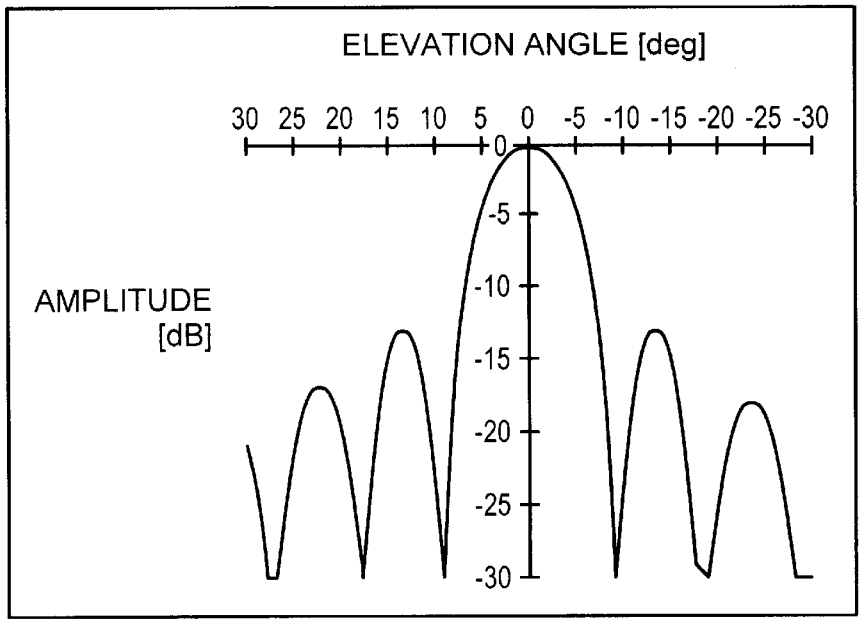
FIGS. 3A–3D are the elevation radiation patterns of the antenna according to FIG. 2.

FIGS. 3A to 3D, respectively, illustrate the elevation radiation patterns for an antenna according to FIG. 2 and in each azimuth direction according to FIG. 1, i.e. FIG. 3A shows the radiation pattern for azimuth A, 3B shows the radiation pattern for azimuth B and so on. The horizontal axis of the graphs indicates the angle of the elevation, in an interval between −30° and 30°, and the vertical axis indicates the amplitude gain having dB unit in the interval between −30 and 0 dB.

Figure 3B:
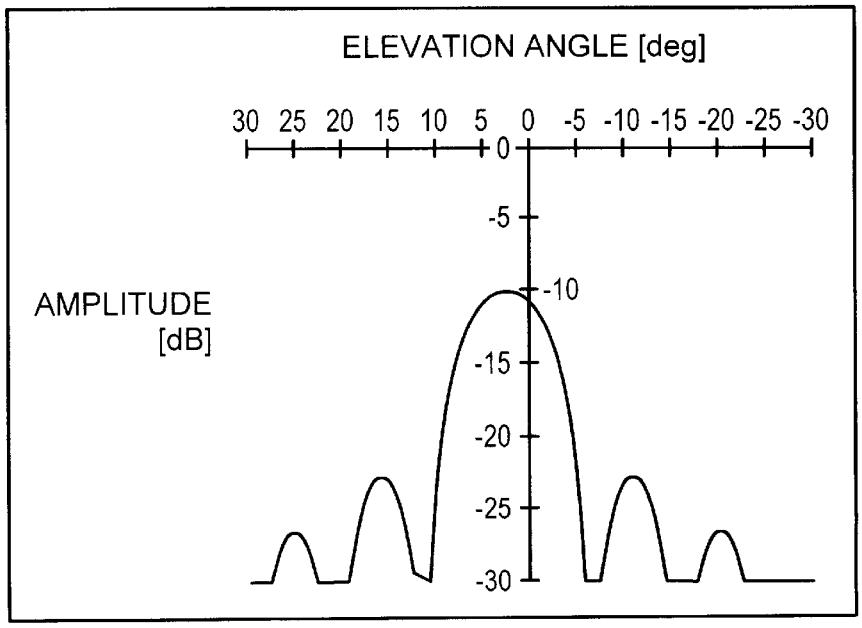
Figure 3C:
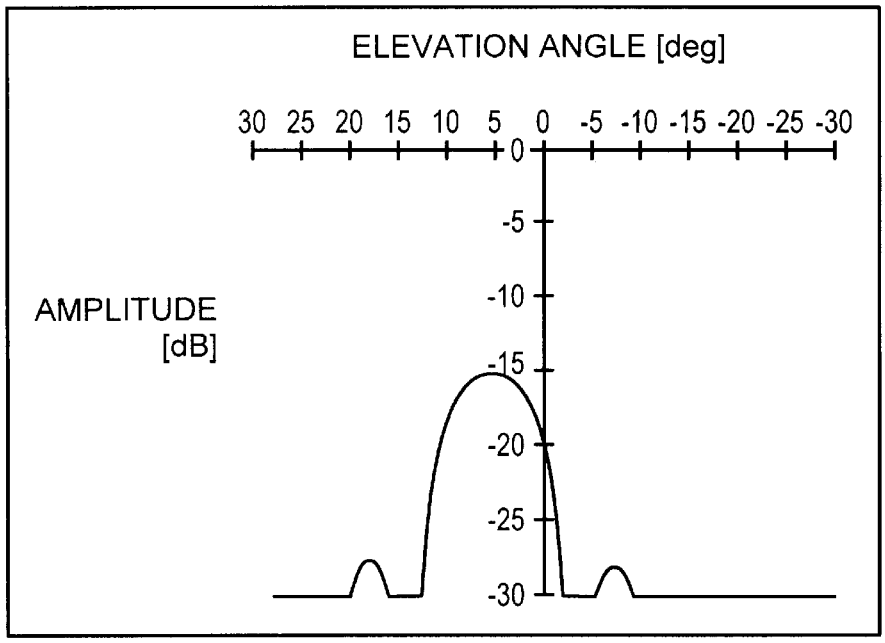
Figure 3D:
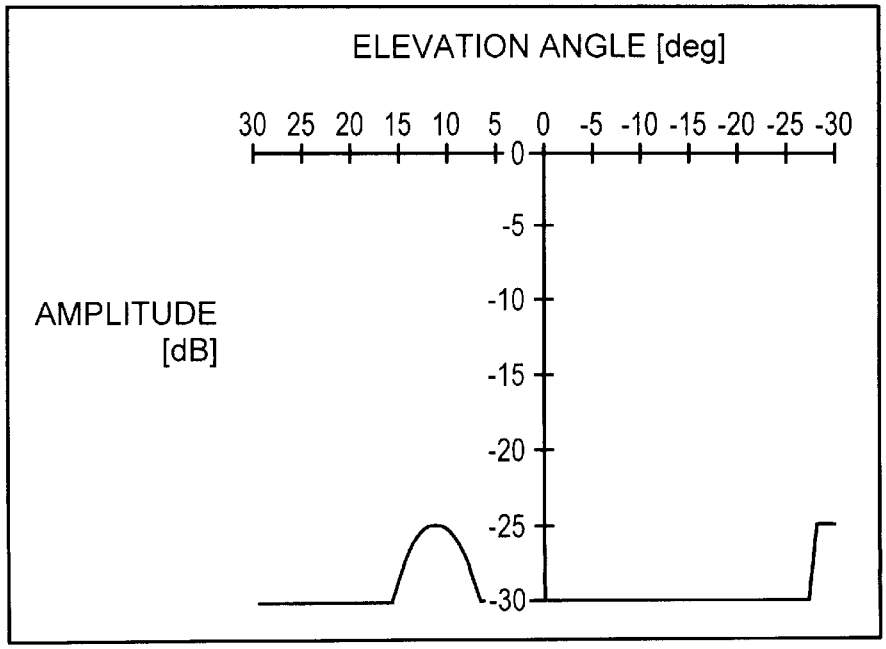

In the following, identical scales are assumed for all cuts of FIGS. 3A–3D. According to FIG. 3A, the amplitude peak is at 0° elevation. In FIG. 3B the amplitude maximum is at about 3° and the amplitude gain at 0° is about −12 dB. In this direction and at zero angle of elevation, the gain is reduced by approximately 2 dB compared with an antenna with no tilt. Nevertheless, it has shown that the influence on the coverage is normally not significant. By widening the azimuth beam-width, compensating for the relative gain reduction is possible. In some installations the effect of the adjustment of the elevation of the outer regions of the main beam with respect to the main beam center line can be used for optimizing the cell coverage. According to FIG. 3C the amplitude at direction C has a maximum peak at about 5° and an amplitude of about −23 dB at 0°. Moreover, the rear beam is directed about 12° up from the horizon line, FIG. 3D, which at 0° elevation, results in a low level of back radiation. Through this design, the antenna gains the advantages of the electrical tilt, i.e. low VSWR and high isolation at the same time as a low back radiation is achieved.

Figure 4:
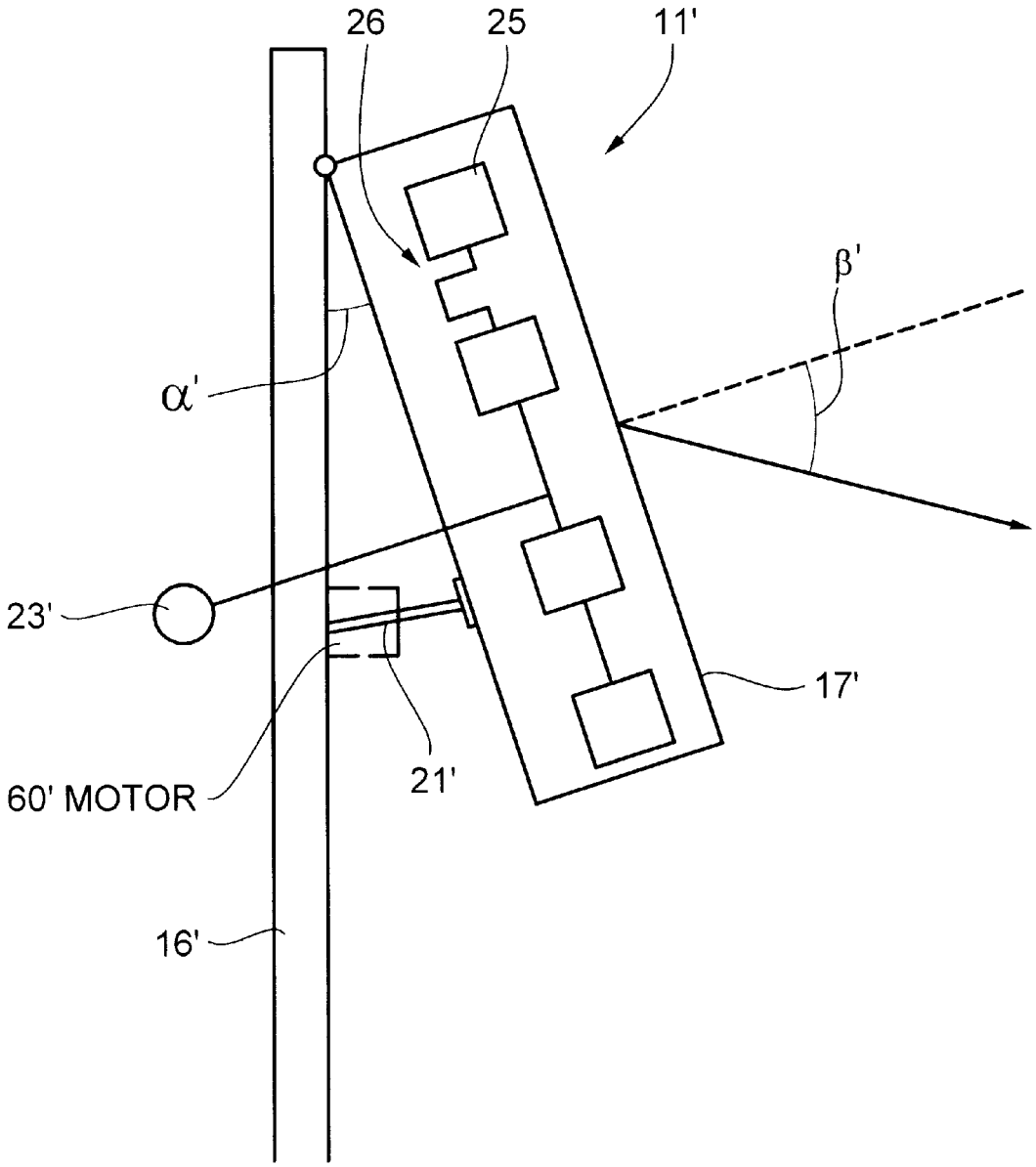
FIG. 4 is a very schematic side view of a second antenna embodiment with mechanical up-tilt and electrical down-tilt according to the present invention.

FIG. 4 shows an embodiment of an antenna 11' tilted mechanically upwards. The antenna 11' is arranged on a mast 16'. The arrow shows the main beam direction of the antenna, which beam is down-tilted electrically. The dashed line indicates the direction along which the antenna beam should have been radiated if no electrical down-tilt was involved. The antenna comprises a housing 17', accommodating a series distribution network 26 and microstrip patch elements 25. The distribution network is fed by a signal through the feed port 23'. The antenna 11' is attached to the mast 16' and up-tilted, for example by means of a bar 21'. The antenna is up-tilted at an angle $\alpha'$, i.e. the angle between the backside of the antenna housing 17' and the mast 16' representing the angle of the inclination of the plane of the antenna elements 25. Furthermore, the main beam of the antenna is electrically down-tilted at an angle $\beta'$, i.e. the angle between the arrow and the dashed line. In this embodiment $\beta'$ is larger than $\alpha'$, and the main beam is directed below the horizon, i.e. substantially below zero angle of elevation.

To electrically tilt the beam, the interconnecting lines of the distribution network 26 between the antenna elements 25 are designed in a suitable way having varying lengths, so that a progressive phase front over the antenna is obtained, resulting in an electrical down-tilt of the beam.

Figure 5A:
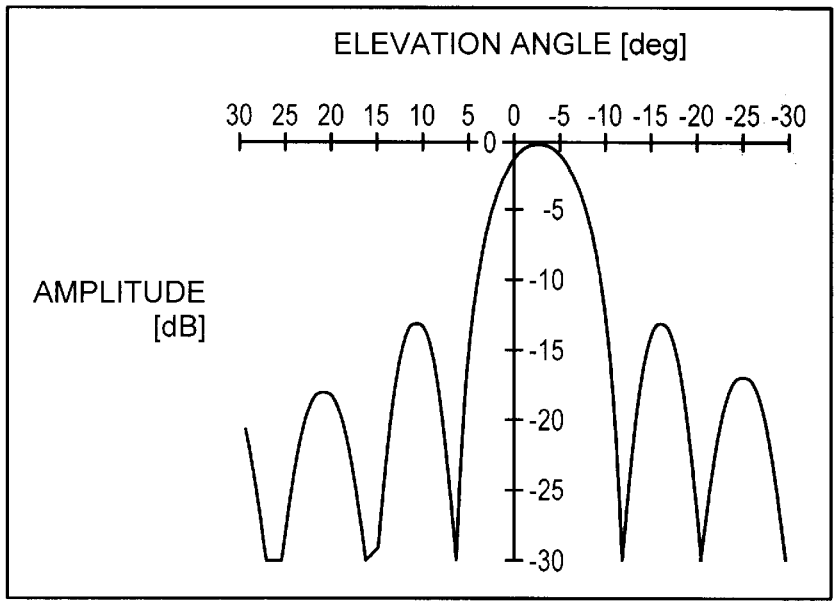
FIGS. 5A–5D are the elevation radiation patterns of the antenna according to FIG. 4.

FIGS. 5A to SD, respectively, illustrate the radiation patterns for an antenna according to FIG. 4 and for each azimuth according to FIG. 1.

Figure 5B:
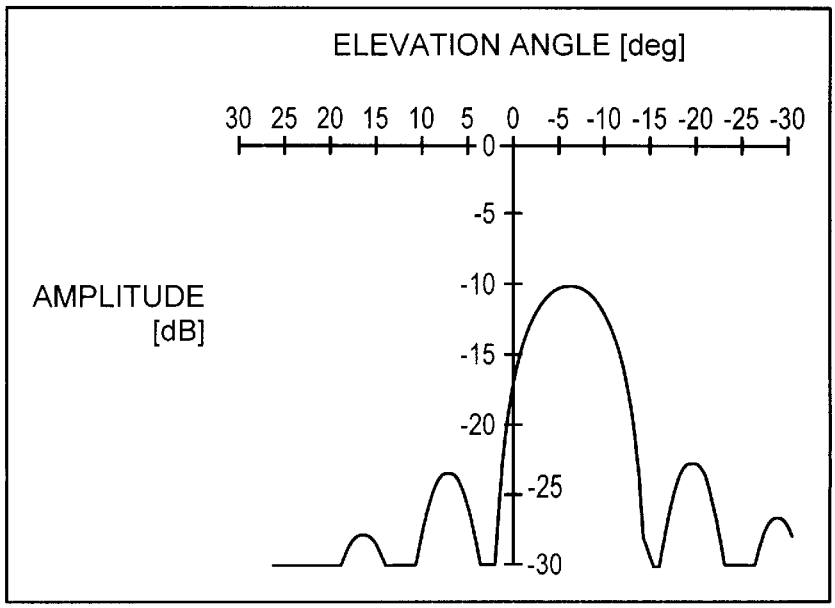
Figure 5C:
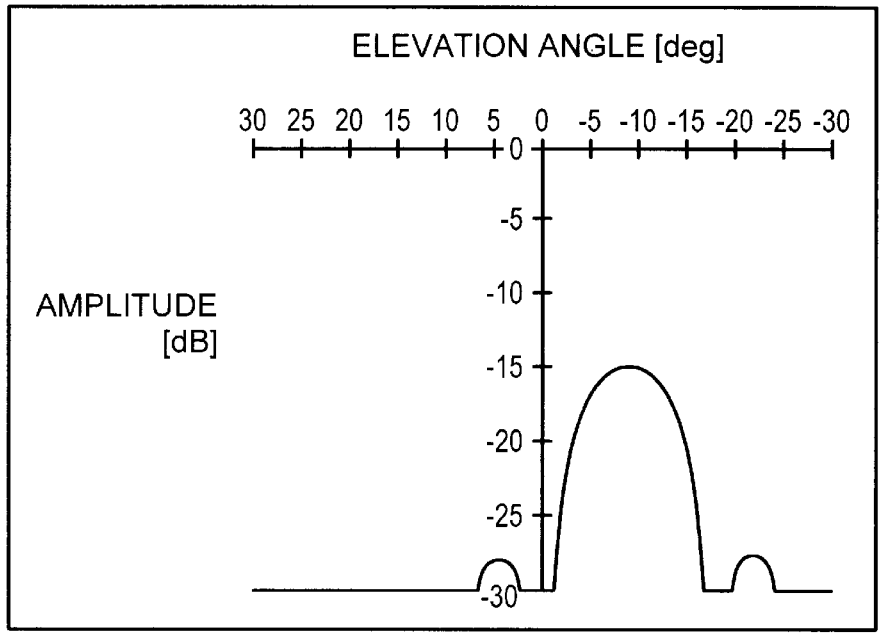
Figure 5D:
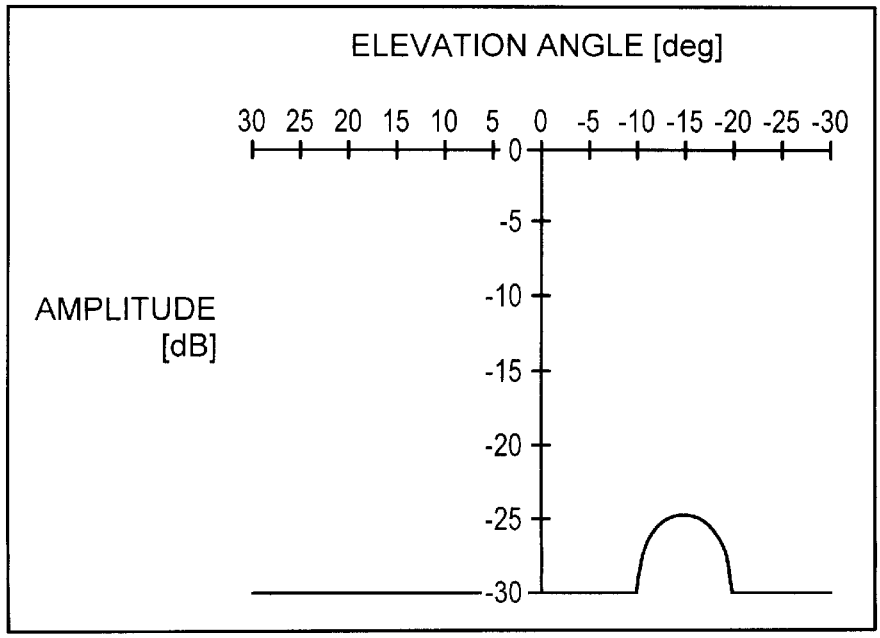

In the following, identical scales are assumed for all cuts of FIGS. 5A–5D. According to FIG. 5A, the amplitude peak is at about −3° angle of elevation. In FIG. 5B the maximum is at about −6° and the amplitude gain at 0° is about −17 dB. In this direction and at zero angle of elevation, the gain is reduced by approximately 2 dB compared with an antenna with no tilt, but it has shown that the influence on the coverage is normally not significant. By widening the azimuth beamwidth it is possible to compensate for the relative gain reduction. In some installations, this effect maybe advantageously used for optimizing the cell coverage as it was described in connection with description of FIG. 3A. Nioreover, the rear beam is directed about −15° down from the horizon, FIG. 5D, which at 0° elevation, results in a low level (well below −30 dB) of back radiation. According to FIG. 5C the amplitude at direction C has a maximum peak at about −9° and an amplitude of about −30 dB at 0°. Also, through this design, the antenna gains the advantages of the electrical tilt, i.e. low VSWR and high isolation at the same time as a low back radiation is achieved.

The antennas according to FIGS. 2 and 4 are assumed to have a uniform taper and a height of 6.4 $\lambda$, where $\lambda$ is the wavelength of the frequency of operation, and are mechanically tilted in an angle of about 6°.

To tilt the beam of the antenna, tilting the antenna elements mechanically or just parts of the antenna and not the entire housing of the antenna is of course possible, as shown in above embodiments.

Figure 6:
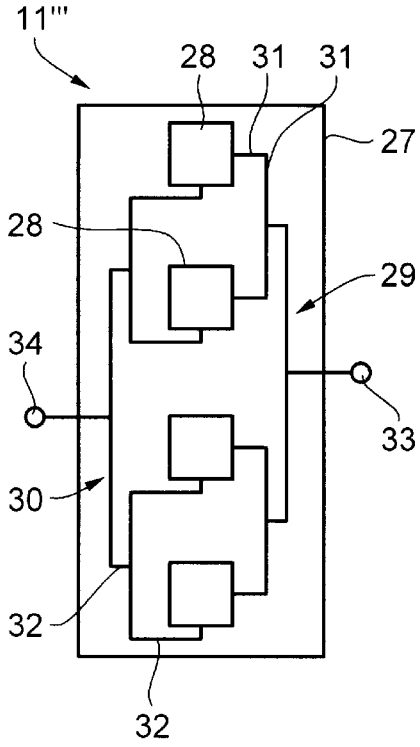
FIG. 6 is a schematic top view of an antenna embodiment using microstrip patches and dual polarization.

The antenna 11 ''' according to FIG. 6 has a two layer structure and comprises a substantially conductive housing and ground plane 27, which constitutes the main antenna structure carrying a number of microstrip patch elements 28 and two distribution networks 29 and 30, consisting of a plurality of conductive conductors 31 and 32, respectively, each being for example etched on one side of a copper-coated thin insulating substrate supported by dielectric distances (not shown). Each distribution network 29, 30 is connected to a feed port 33 and 34, respectively.

Figure 7:
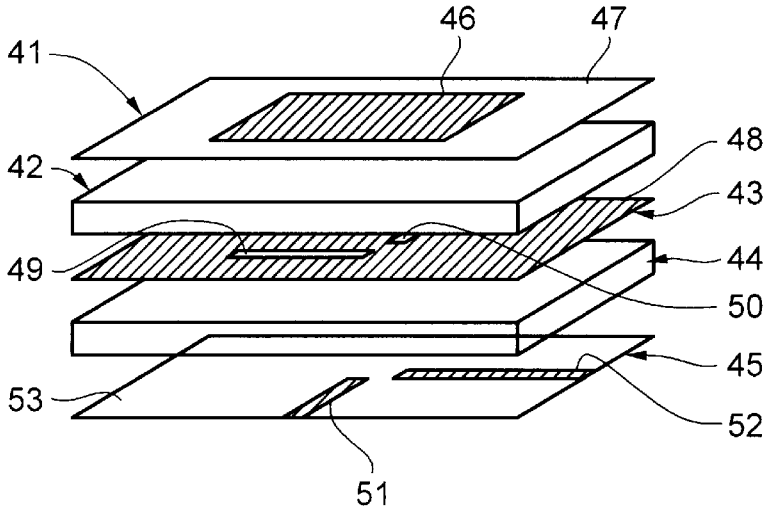
FIG. 7 is a schematic perspective view of an antenna element embodiment using aperture coupled microstrip patch and dual polarization.

FIG. 7 shows another embodiment of a microstrip antenna with the distribution network on one side of the ground plane, feeding the radiating elements on the opposite side of the ground plane through apertures in the ground plane, so-called aperture coupling.

In the multi-layer structure of the antenna, the first layer 41 includes the antenna patch elements 46, which are substantially conductive (etched) layers, for example of copper, arranged on an insulating substrate 47, for example a substantially rigid sheet of glass fiber or polymer material. The substrate 47 can carry one or more antenna patch elements. A plurality of the patch elements on the substrate form the antenna plane.

Between the first layer 41 and the third layer 43, a second layer 42 of dielectric material is inserted. The third layer 43 is of a conductive material 48 and arranged with apertures 49 and 50, in an essentially perpendicular configuration, for each polarization line, respectively, and connected to the ground providing the ground plane, substantially parallel to the antenna elements. The ground plane forms a shielding and reflecting surface, and substantially amplifies the directivity of the antenna elements 46. The apertures polarise the supplied signal so that each aperture feeds the antenna elements with a predetermined polarization. The polarization is determined by the direction of each aperture.

The forth layer 44 is substantially of a dielectric material spacing the third layer 43 from the fifth layer 45. The fifth layer 45 is a substantially insulating sheet 53 carrying the conductors 51 and 52 of the distribution networks on one side facing the patches.

The apertures 49 and 50 on layer three and the end of the conductors 51 and 52 of the fifth layer are so arranged that the apertures 49 and 50 intersect the conductors 51 and 52, respectively so that a cross configuration is obtained.

Consequently, the antenna formed in this way can radiate and receive signals having one or both of horizontal and vertical polarization. When tilting electrically, the length of the conductors 51 or 52 may be varied to obtain a desired tilting effect. The mechanical tilting is obtained by inclining the antenna housing 27 (FIG. 6) or the multi-layer structure of the antenna.

We have shown and described some preferred embodiments for exemplifying reasons, however, the invention can clearly be varied in a number of different ways within the scope of the claims. For example, the bar for mechanical tilting can have adjustable length or the tilting may be carried out using (remote controlled) step motors 60 and 60 ' as shown in FIGS. 2 and 4, respectively, or the like, and the electrical tilting may be adapted in relation to the mechanical tilting by varying the feed lines in several ways. In some embodiments, the line length variation can be either fixed, i.e. selected before manufacturing, adjustable on site through selection among a set of built-in line lengths with a connecting device or finally remotely controlled using phase shifting devices in a known way.

Even though, the embodiments emphasise the parameters for transmitting mode of the antenna, it is obvious for a skilled person that the same parameters and characteristic behaviours are adaptable for antennas operating in receiving mode.

REFERENCE SIGNS

| | |
|---|---|
| 10 | Mobile communications system cell |
| 11, 11' ,11'" | Antenna |
| 12 | Frontal radiation |
| 13 | Rear radiation |
| 14, 15 | Side radiation |
| 16, 16' | Supporting structure |
| 17, 17' | Casing |
| 18 | Distribution network |
| 19 | Dipole antenna element |
| 20 | Cover |
| 21 | Tilting device |
| 22 | Hinge |
| 23 | Feed port |
| 24 | Distribution line |
| 25 | Microstrip patch antenna element |
| 26 | Distribution network |
| 27 | Housing |
| 28 | Microstrip patch element |
| 29, 30 | Distribution networks |
| 31, 32 | Conductors |
| 33, 34 | Feed ports |
| 41 | First layer |
| 42 | Second layer |
| 43 | Third layer |
| 44 | Forth layer |
| 45 | Fifth layer |
| 47 | Substrate |
| 48 | Conductive layer |
| 49, 50 | Apertures |
| 51, 52 | Conductors |
| 53 | Insulating carrier |

What is claimed is:

1. A method for improving performance parameters of an antenna arrangements which substantially comprises a radiating device, arranged for radiating a beam in a substantially predefined first direction, said radiating device being provided on a supporting structure, said antenna arrangement further comprising a first device for tilting the radiating device mechanically and a second device for tilting the beam from said radiating device electrically, wherein the method comprises the steps of:

mechanically tilting the radiating device in a second direction and in a first anile to redirect the beam away from said substantially predefined first direction by means of said first device, and electrically tilting the beam in a third direction and a second angle, said third direction and second angle being opposite to said second direction and first angle.

2. The method of claim 1, wherein said second angle is substantially same size as said first angle.

3. The method of claim 1, wherein the second direction is substantially downwards and the third direction is substantially upwards.

4. The method of claim 1, wherein the second direction is substantially upwards and the third direction is substantially downwards.

5. The method of claim 1, wherein the mechanical tilting is adjustable.

6. The method of claim 5, wherein the mechanical tilting is remote-controlled.

7. The method of claim 1, wherein the mechanical tilting is fixed.

8. The method of claim 1, wherein the electrical tilting is adjustable.

9. The method of claim 8, wherein the electrical tilting is remote-controlled.

10. The method of claim 1, wherein the electrical tilting is fixed.

11. An antenna arrangement comprising a radiating device for radiating a beam in a substantially predefined first direction, said radiating device being provided on a supporting structure, at least a first mechanical tilting device to mechanically tilt the radiating device in a second direction substantially diverging from said predefined first direction and in first angle, and a second electrical tilting device to electrically tilt said beam in a third direction and in a second angle opposite to said second direction and first angle.

12. The antenna arrangement of claim 11, wherein said second angle is the same size as said first angle.

13. The antenna arrangement of claim 11, wherein the first device for mechanical tilting, directs the radiating device substantially downwards and the second device for electrically tilting the beam directs the beam substantially upwards.

14. The antenna arrangement of claim 11, wherein the first device for mechanical tilting, directs the radiating device substantially upwards and the second device for electrically tilting the beam directs the beam substantially downwards.

15. The antenna arrangement of claim 11, wherein the first device includes a bar, a hinge or a motor.

16. The antenna arrangement of claim 11, wherein the mechanical tilting device provides adjustable tilting.

17. The antenna arrangement of claim 16, wherein is remote-controlled.

18. The antenna arrangement of claim 11, wherein the mechanical tilting device provides fixed tilting.

19. The antenna arrangement of claim 11, wherein the electrical tilting device provides adjustable tilting.

20. The antenna arrangement of claim 19, wherein the electrical tiling device is remote-controlled.

21. The antenna arrangement of claim 11, wherein the electrical tilting-device provides fixed tilting.

22. The antenna arrangement of claim 11, wherein the radiating device comprises dipole elements arranged in groups and energized through a distribution network.

23. The antenna arrangement of claim 22, wherein the distribution network includes distribution lines having adjustable lengths and electrically tilting of the beam is performed by substantially adjusting the lengths of the distribution lines of the distribution network, which results in different feeding phase length to the dipole elements producing a substantially progressive phase front over the antenna and in an electrical tilt of the beam.

24. The antenna arrangement of claim 11, wherein the radiating device comprises microstrip patch elements energized through at least one distribution network.

25. The antenna arrangement of claim 24, wherein the distribution network includes interconnecting lines, and the interconnecting lines of the distribution network between the microstrip patch elements are designed to produce a progressive phase front over resulting in an electrical tilt of the beam.

26. An antenna including an antenna element portion comprising:

a first layer constituting radiating means directable in a substantially predefined direction and including conductive layers arranged on an insulating substrate, a second layer of a conductive material connected to ground and having at least one first aperture and second aperture arranged substantially perpendicular to each other, first and second distribution networks including first and second group of conductors connected to first and second feed ports, a device for mechanically tilting the radiating means in a first direction, substantially diverging from said predefined direction, and means to tilt said beam in a second, substantially opposite, direction electrically.

27. An antenna according to claim 26, wherein the first aperture is arranged substantially horizontally and the second aperture is arranged substantially vertically to polarize the radiated beam vertically and horizontally, respectively.

28. A base station antenna of a cellular communications system including an arrangement comprising a radiating device for radiating a beam in a substantially predefined first direction, said radiating device being provided on a supporting structure, at least a first mechanical tilting device to mechanically tilt the radiating device in a second direction substantially diverging from said predefined first direction and in first angle and a second electrical tilting device to electrically tilt said beam in a third direction and in a second angle opposite to said second direction and first angle.

* * * * *